US008600086B2

(12) United States Patent
Jensen et al.

(10) Patent No.: US 8,600,086 B2
(45) **Date of Patent: *Dec. 3, 2013**

(54) METHOD FOR CONTROLLING THE DIRECTIONALITY OF THE SOUND RECEIVING CHARACTERISTIC OF A HEARING AID AND A SIGNAL PROCESSING APPARATUS

(75) Inventors: Lars Baekgaard Jensen, Varlose (DK); Kristian Tjalfe Klinkby, Varlose (DK)

(73) Assignee: Widex A/S, Lynge (DK)

( * ) Notice: Subject to any disclaimer, the term of this patent is extended or adjusted under 35 U.S.C. 154(b) by 111 days.

This patent is subject to a terminal disclaimer.

(21) Appl. No.: 13/044,959

(22) Filed: Mar. 10, 2011

(65) Prior Publication Data

US 2011/0164771 A1 Jul. 7, 2011

Related U.S. Application Data

(60) Division of application No. 11/377,678, filed on Mar. 17, 2006, now Pat. No. 7,933,423, which is a continuation-in-part of application No. PCT/EP03/10485, filed on Sep. 19, 2003.

(51) Int. Cl.
*H04R 25/00* (2006.01)

(52) U.S. Cl.
USPC ..... 381/313; 381/312; 381/92

(58) Field of Classification Search
USPC ..... 381/91, 92, 93, 122, 312, 313, 317, 381/318, 356
See application file for complete search history.

(56) References Cited

U.S. PATENT DOCUMENTS

| | | | | |
|---|---|---|---|---|
| 5,483,599 | A * | 1/1996 | Zagorski | 381/327 |
| 6,002,776 | A | 12/1999 | Bhadkamkar | |
| 6,272,229 | B1 | 8/2001 | Baekgaard | |
| 6,424,721 | B1 | 7/2002 | Hohn | |
| 6,539,096 | B1 | 3/2003 | Sigwanz | |
| 6,704,422 | B1 | 3/2004 | Jensen | |
| 2004/0081327 | A1 | 4/2004 | Jensen | |

FOREIGN PATENT DOCUMENTS

| | | | |
|---|---|---|---|
| DE | 199 48 907 | A | 2/2001 |
| DE | 10114101 | A1 | 6/2002 |
| EP | 1 017 253 | A | 7/2000 |
| WO | 00/76268 | A | 12/2000 |

* cited by examiner

*Primary Examiner* — Huyen D Le
(74) *Attorney, Agent, or Firm* — Sughrue Mion, PLLC

(57) ABSTRACT

A signal processing apparatus (100) for a hearing aid with a controllable directional characteristic is provided which comprises a directional controller (10) receiving first and second microphone signals (20, 30) and output an output signal (40), a signal analyzer (70) which detects whether at least one of said first and second microphone signals being undesired signals, and wherein said directional controller minimizes the output signal by adjusting the directional characteristic only if the signal analyzer has detected undesired signals.

15 Claims, 9 Drawing Sheets

Envelope and Percentile Levels

Omni parameter with and without DSD circuit

METHOD FOR CONTROLLING THE DIRECTIONALITY OF THE SOUND RECEIVING CHARACTERISTIC OF A HEARING AID AND A SIGNAL PROCESSING APPARATUS

RELATED APPLICATIONS

The present application is a divisional of U.S. application Ser. No. 11/377,678 filed Mar. 17, 2006, which is a continuation-in-part of application No. PCT/EP2003/010485, filed on Sep. 19, 2003, in Europe and published as WO-2005/029914-A1.

BACKGROUND OF THE INVENTION

1. Field of the Invention

The present invention generally relates to hearing aids. The invention, more specifically, relates to a hearing aid with a controllable directional characteristic. The invention, still more specifically, relates to a method for controlling the directionality of the sound receiving characteristic for minimizing noise and to a signal processing apparatus for carrying out the method.

2. The Prior Art

In hearing aids, acoustic signal-to-noise ratio can be significantly improved by, e.g., using dedicated directional microphones or equivalently by a pair of omni-directional microphones followed by a delay and subtracting procedure to employ a directional sound receiving characteristic. Hearing aids with more than two microphones have also been developed in the pursuit of highly selective directionality.

Hearing aids having a directional sound receiving characteristic are useful to improve speech perception in noisy environments, where human speech may be received simultaneously from different directions, as is the case, e.g., in the noise environment frequently referred to as cocktail party noise.

With a directional sound receiving characteristic, e.g., in the shape of a cardoid or super-cardoid characteristic, the speech perception in a hearing aid is improved by reduced perception of sound coming from the back and the sides of the user while maintaining the level of sound coming from the area in front of the user.

On the other hand, in environments with only a low noise level or no significant speech signal, the hearing aid user will normally prefer an omni-directional or spherical sound receiving characteristic offering the same perception of sound irrespectively of the direction from which it arrives.

To further improve the signal-to-noise ratio, hearing aids with adaptive directional functionality have been introduced with the aim to place significant damping in the direction of the dominant noise source.

WO 01/01731-A1 discloses a method for controlling the directionality of a sound receiving characteristic of a hearing aid. The hearing aid comprises spaced apart microphones, wherein the sound receiving characteristic may change between an omni-directional characteristic and a directional characteristic. In this hearing aid, an adjustable time or phase delay may be imposed. The directional characteristic may be created by adjusting the delay of a delay device to be the same as the acoustic delay between the back microphone and the front microphone. With this delay, signals that are first received at the back microphone and are later received at the front microphone, are suppressed in an adding circuit, where the delayed signal of the back microphone is subtracted from the output signal of the front microphone. The hearing aid may exercise a smooth change-over between an omni-directional characteristic and a directional characteristic, substantially without changing the phase relationship or time delay and the amplitude characteristic of the signal.

Both the fixed and the adaptive directional functions however suffer from a reduced signal-to-noise ratio because of lack of low frequency sensitivity for acoustic signals, since one consequence of adding a signal (from the front microphone) with its delayed and inverted replicate (from the back microphone) to achieve a directional advantage is that the sensitivity of the microphone at low frequencies is reduced also for sounds presented directly in front of the listener. For a given delay and distance between microphones, the low frequency sensitivity rolls off at a rate of 6 dB per octave. This loss of sensitivity in the low frequencies can reduce the overall loudness of sounds, and may effect speech perception and sound quality (see Kuk, F.; Baekgaard, L.; Ludvigsen, C.: Design considerations in directional microphones; in The Hearing Review, September 2002, vol. 7, No. 9, pages 68, 70-73).

To compensate the reduced sensitivity at low frequencies, one could consider a frequency dependent amplification of the microphone signals. However, a frequency dependent amplification will not effect the signal-to-noise ratio but will as a consequence raise the microphone noise by the same amount.

It is therefore an objective of hearing aids with adaptive directional functionality to be able to change from an omni-directional characteristic in quiet situations to a full directional characteristic in noisy environments. Present adaptive systems distinguish between desired signals and undesired signals by the assumption that desired signals, e.g., speech signals, are those coming from the frontal direction of the user of the system, e.g., a hearing aid, whereas undesired signals, e.g., noise signals, are those coming from any other direction. According to this assumption, the signal-to-noise ratio is improved by changing the sound receiving characteristic from an omni-directional mode to a full directional mode since the improvement in signal-to-noise ratio (SNR) is correlated to the directivity index (DI) of a directional microphone.

Present adaptive systems like the directional controller disclosed in WO 02/085066-A1 adjusts the directional characteristic by minimizing the output signal of the system. Since signals coming from the frontal direction are not affected by changing the directional characteristic of the system, a minimization of the output signal results in damping of—and an improvement of the signal-to-noise-ratio. However, such a signal-to-noise-ratio optimization applies only if the desired signals are coming from the frontal direction and noise signals are coming from another direction.

In a situation when a single person is speaking from one side of the user of the adaptive system, the speech may very well be a desired signal. However, the above described adaptive systems will try to damp this speech signal in order to minimize the output signal, and thereby increase the microphone noise. Furthermore, in quiet situations when the person is not speaking, the adaptive system will try to damp the microphone noise. This results in dynamically undesired damping of the actual desired signal and a significant modulation of the microphone noise, reducing speech perception and sound quality.

A supposed solution to the problem seems to be to modify the microphone signals as input signals for the adaptive function or to modify the output signal as the control signal in the adaptive function. Such modifications have the following drawbacks. One problem is that the possible modifications of signals in the signal path, e.g., filtering away undesired frequency areas, are very limited, because the following adaptation algorithm needs the gain and the delay information of the input signals to be able to adapt correctly. For this reason, a signal modification that, e.g., just leaves the envelope of the two microphone signals is not possible.

Another problem is that adaptive systems generally should adapt the output signal relatively soon after the input signals have changed. If not, the system would adjust the characteristic only after a certain delay in which the system is not correctly adapted.

Furthermore, adaptive systems generally should receive the response to a parameter change relatively soon after the parameter has changed. If not, the system would change the parameter further in a certain direction, before getting the response that the parameter change in this direction was in fact erroneously. As a result, such an adaptive system with a delayed response will not reach its optimum very precisely, if at all, and may become unstable.

Algorithms for separating signals with different characteristics, e.g., separating noise from desired speech signals, generally need a certain amount of time to react, e.g., when applying a filter function. Therefore, the implementation of such algorithms in the signal path either prior to the adaptive function or in the feedback path, e.g., by providing a noise pass filter for the output signal controlling the parameter adjustment, conflict with the desire for having a fast response in order to make the adaptive system work, so that such signal modifications do normally not work in most cases.

On this background, it is an object of the present invention to provide an adaptive system and a method of the kind defined, in which the deficiencies of the prior art are remedied and, in particular, to provide a method and an adaptive system of the kind defined which allow to minimize undesired signals without adversely affecting desired signals, even if the desired signals are coming from other directions than the main or frontal direction.

SUMMARY OF THE INVENTION

The present invention overcomes the foregoing and other problems by providing an adaptive directional function which minimizes only undesired signals, e.g., undesired noise. Signals that comprise wanted signals like speech signals are herein after referred to as desired signals.

The invention, in a first aspect, provides a signal processing apparatus for a hearing aid with a controllable directional characteristic comprising a directional controller for receiving first and second microphone signals, and outputting an output signal, and a signal analyzer for detecting whether at least one of said first and second microphone signals are undesired signals, wherein said directional controller minimizes the output signal by adapting the directional characteristic only if the signal analyzer has detected undesired signals.

The invention, in a second aspect, provides hearing aid comprising a first and a second input microphone, a directional controller for receiving first and second microphone signals from said microphones and outputting an output signal, a signal analyzer for detecting whether at least one of said first and second microphone signals comprises desired signals and for setting a disable signal in the event desired signals are detected, wherein said directional controller is adapted for performing an adaptive operation so as to minimize the output signal only while said disable signal is not set.

Methods, apparatuses, systems and articles of manufacture consistent with the present invention use a detecting mechanism to detect that only undesired signals are submitted as input signals to the adaptive directional function, and the adaptive directional function then adjusts the directionality of a sound receiving characteristic in order to minimize the output signal of the adaptive directional function.

In other words, if the detection mechanism detects that the input signals to the adaptive directional function also comprise desired signals, adjustment of the directionality of the sound receiving characteristic of the adaptive directional function is stalled for a certain amount of time.

According to an aspect of the present invention, the adaptive directional function receives an additional control signal from a signal analyzer that effectively provides a desired signal detector (DSD). The DSD generates this additional control signal for the adaptive directional function, which allows one or more of the original control parameters to be updated only if the DSD concludes that the input signals to the adaptive directional function are undesired signals. If the DSD concludes that the input signals are desired signals or a mixture of desired and undesired signals, the control parameters of the adaptive directional function will not be updated, and the adaptation is stalled. Thus, the adaptive directional function works on unmodified input signals and further requires no modification of the fed back output signal. The additional control signal submitted by the DSD indicates to stall or to update the adaptation in the adaptive directional function. The additional control signal is generated in the DSD outside the main signal path between input and output signals, so that the generation of the additional control signal may be done in different ways, including ways that could distort the input signals and could be very complex, without affecting the quality of the output signal. Dependent on what is considered as desired and undesired signals, the DSD may use statistical analysis of the input time signal, distinguish between high and low frequency signals, detect whether the input signal level is above or below a certain fixed limit, detect whether the incoming signals are sufficiently correlated, or distinguish between desired and undesired signals by applying any other suitable decision rule.

The adaptive directional function is to be understood as a directional controller receiving at least first and second microphone signals supplied by a first (front) microphone and a second (back) microphone as input signals and which outputs an output signal, wherein the output signal is generated by combining the first and second microphone signal according to the present directional characteristic adjusted by the directional controller.

The invention, in a third aspect, provides a method of controlling the directional characteristic of a hearing aid having spaced apart first and second microphones, a directional controller receiving first and second microphone signals supplied by said first and second microphones, respectively, and outputting an output signal, wherein said output signal is generated by combining said first and second microphone signals according to the directional characteristic; said method comprising the steps of detecting whether at least one of said first and second microphone signals contain undesired signals; and adapting the directional characteristic in order to minimize the output signal only if undesired signals have been detected.

The invention, in a fourth aspect, provides a method of controlling the directional characteristic of a hearing aid having spaced apart first and second microphones, said method comprising the steps of receiving in a directional controller first and second microphone signals supplied by said first and second microphones, respectively, generating an output signal by combining said first and second microphone signals according to the directional characteristic; applying an adaptive directional function in which at least one of said first and second microphone signals are delayed or attenuated according to an internal control parameter and then combined to provide an output signal, detecting whether at least one of said first and second microphone signals contain a desired signal and signaling the detection of a desired signal by setting a disable signal, and disabling the adaptive directional function if said disable signal is set.

In accordance with apparatuses and articles of manufacture consistent with the present invention, a signal processing apparatus for a hearing aid with a controllable directional characteristic comprising a directional controller for receiving first and second microphone signals and outputting an output signal and a signal analyzer for detecting whether at least one of the first and second microphone signals are undesired signals is provided. The directional controller receives first and second microphone signals submitted by, e.g., a front and a back microphone, respectively, and outputs an output signal. The signal analyzer that effectively provides a desired signal detector determines whether the first and/or second microphone signals are undesired signals, and the directional controller minimizes the output signal by adjusting the directional characteristic only if the desired signal detector has detected undesired signals.

As long as a speaker emitting desired speech signals is at the front of the user, the signal processing apparatus according to the present invention and a conventional system behave nearly similar, but when the speaker moves, e.g., to one side of the user, the apparatus according to the invention will avoid attempts at trying to adjust the directional characteristic in order to minimize the output signal with the risk of suppressing the speaker.

According to the present invention, the signal processing apparatus with the desired signal detector stays basically in omni-directional characteristic also when the speaker moves to one side of the user, because the DSD forces the directional controller not to optimize its directional characteristic while the speaker sentences and only allows the directional controller to adapt the directional characteristic during the pauses when the speaker does not sentence. Thus, the directional controller only tries to minimize the microphone noise which is dominant during the pauses, and which is best done by staying in omni-directional characteristic. Thus, the microphone noise stays low and is not fluctuating and a desired signal coming from one side of the user is not damped so that speech perception and sound quality is improved.

In accordance with systems consistent with the present invention, a hearing aid with a controllable directional characteristic is provided. The hearing aid comprises an adaptive directional function of which the adaptation is stalled for a certain amount of time if desired signals have been detected as input signals submitted by spaced apart first and second sound receiving means. The processed input signals are output as a combined output signal by the adaptive directional function. The hearing aid further comprises an output transducer for emission of sound signals in response to the output signal.

The invention also provides a software tool for implementing a directional controller on a signal processing apparatus and a computer program product comprising computer program code which, when executed on a computer or a signal processing system, enables the computer or signal processing system to carry out a method according to the present invention.

The methods, systems and articles of manufacture consistent with the present invention are preferably used in all kinds of hearing aids having a directional characteristic (e.g., behind the ear (BTE), in-the-ear (ITE), in-the-channel (ITC)) for all degrees of hearing loss to improve the ability of a user to understand desired signals like voice or speech signals or sound signals emitted by a radio or TV or other. Said desired signals may come from any direction of the user.

The above-mentioned and other features, benefits and advantages of the invention will become apparent from the following detailed description of the preferred embodiments of the invention together with the accompanying drawings.

Other systems, methods, features and advantages of the invention will be or become apparent to one skilled in the art upon examination of the following figures and detailed description. It is intended that all such additional systems, methods, features and advantages be included within this description, be within the scope of the invention and be protected by the accompanying claims.

BRIEF DESCRIPTION OF THE DRAWINGS

The invention will now be described in more detail in conjunction with several embodiments and the accompanying drawings, in which.

DETAILED DESCRIPTION OF THE INVENTION

The present invention will now be described with reference to the accompanying drawings.

Figure 1:
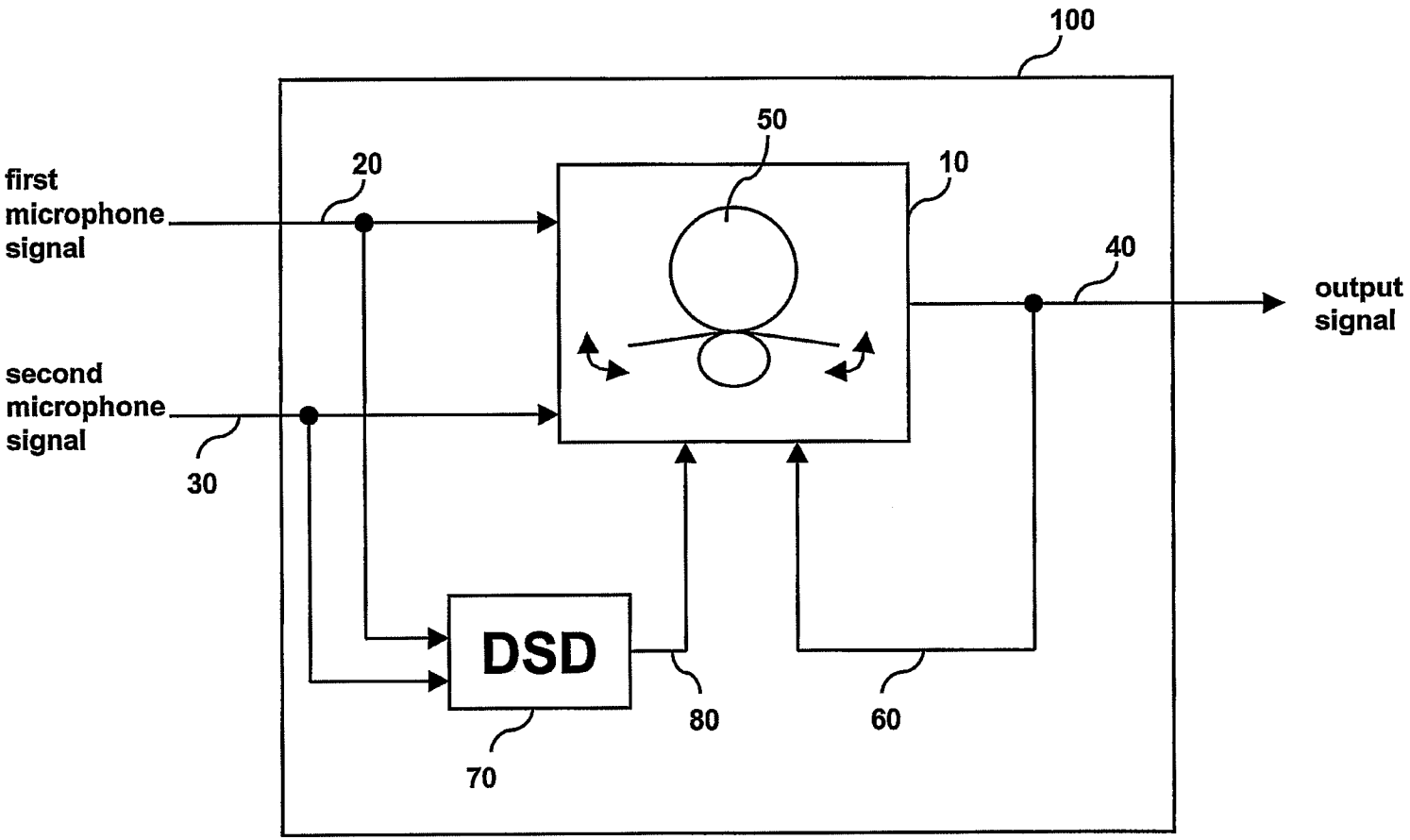
FIG. 1 depicts a block diagram of a signal processing apparatus for a hearing aid with a controllable directional characteristic according to a first embodiment of the present invention.

FIG. 1 depicts a block diagram of a signal processing apparatus 100 suitable for a hearing aid with a controllable directional characteristic and for practicing methods and implementing a system, consistent with an embodiment of the present invention. The signal processing apparatus 100 comprises a directional controller 10 which receives first and second microphone signals 20, 30 and outputs output signal 40. First and second microphone signals may submitted by a first (front) microphone Fmic and a second (back) microphone Bmic directly, or via preprocessing function, e.g., a filter function. The output signal 40 may be used as an input signal for a signal processor of the hearing aid for further processing and amplifying the output signal and submitting signals output from said signal processor to an output transducer, e.g., a loudspeaker, for emission of sound signals (not shown in FIG. 1).

The directional controller 10 is capable of applying an adaptive directional function 50 onto the first and second microphone signals 20, 30. As a result of the adaptive directional function 50, the combined output signal 40 is provided.

The directional characteristic of the adaptive directional function 50 is adjusted by first and second control parameters 60, 80. First control parameter 60 is the fed back output signal 40. The signal processing apparatus 100 further comprises a signal analyzer, also referred to as a desired signal detector (DSD) 70, receiving first and second microphone signals 20, 30 and outputting second control parameter 80. In another embodiment, not illustrated in FIG. 1, the desired signal detector 70 may receive just one of the first or second microphone signals as input signal.

In operation, sounds from the environment of the hearing aid are picked up by both the first front microphone Fmic and the second back microphone Bmic (not shown). The electrical signals generated by the two microphones may then be preprocessed by a sample unit at a sampling rate of, e.g., 32 kHz, and further analogue-digital converted by, e.g., a 24 bit analogue-to-digital-converter. The resulting digital signals corresponding to the sounds picked up by the microphones are then submitted as first and second microphone signals 20, 30.

Figure 5:
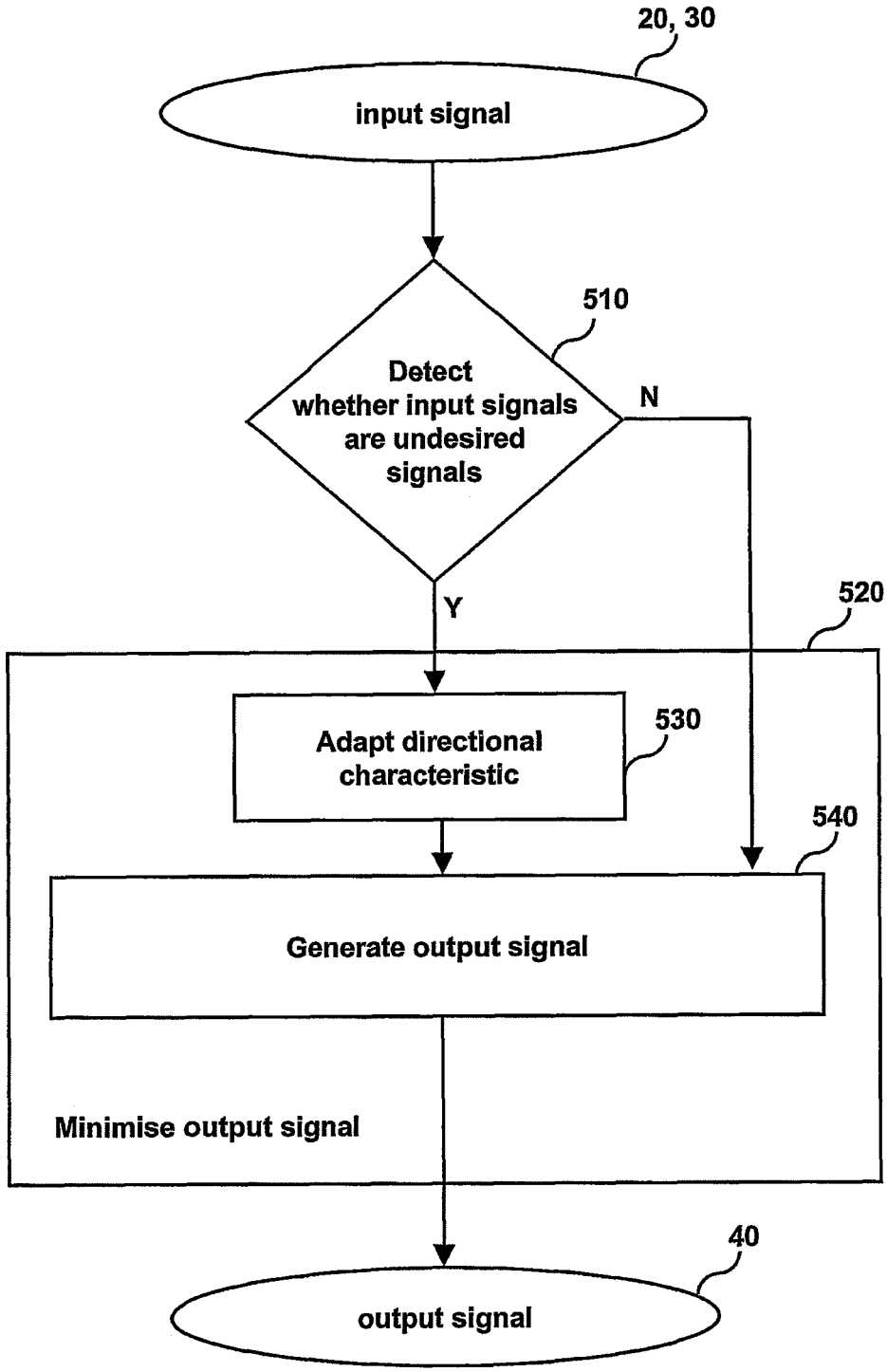
FIG. 5 depicts a flow diagram illustrating a method according to an embodiment of the present invention.

The function of the signal processing apparatus 10 will now be described also with reference to FIG. 5 which shows a method according to the present invention.

The directional controller 10 processes the first and second microphone signals 20, 30 according to the adjusted directional characteristic of the adaptive directional function 50 and combines these processed signals to the output signal 40. The adaptive directional function is adjusted by internal delay and attenuation parameters (internal parameters) to delay and attenuate the first and second microphone signals (not shown in FIG. 1). The adaptive directional function 50 adjusts the internal parameter such that the fed back output signal 60 is minimized. The adaptive control of the internal parameters in the adaptive directional function by minimizing the output signal is carried out by measurements known in the art, e.g., by applying a so-called LMS-algorithm in the adaptive directional function. Examples of such adaptive control with an LMS-algorithm can be found in, e.g., U.S. Pat. No. 5,259,033 or U.S. Pat. No. 5,402,496, however, the adaptive control systems provided in these references do not control a directional controller.

At the same time, the desired signal detector 70 detects in operation 510 whether the first and second microphone signals as input signals are undesired signals. In the meaning of the present invention, an undesired signal is a signal comprising only noise and no desired signals, like speech signals. If the DSD 70 in operation 510 detects desired signals, then adaptation of the internal parameter is blocked or frozen so that the adaptive directional function does not adjust the internal parameters by adapting them according to the current fed back output signal. Hence, the minimization of the output signal in operation 520 is stalled for a certain amount of time since the output signal is generated in operation 540 without adaptation of the internal parameters. The stall time depends on the input signals and the actual implementation of the DSD. For example, the stall time may have a value in the range of 3 to 30 ms.

If it is detected in operation 510 that the input signals are "undesired signals", the adaptation continues and the internal parameters are adjusted to adapt the directional characteristic in operation 530 in order to minimize the output signal (operation 520).

As a result, the directional characteristic is only adapted if the DSD detects undesired signals as input signals.

Figure 2:
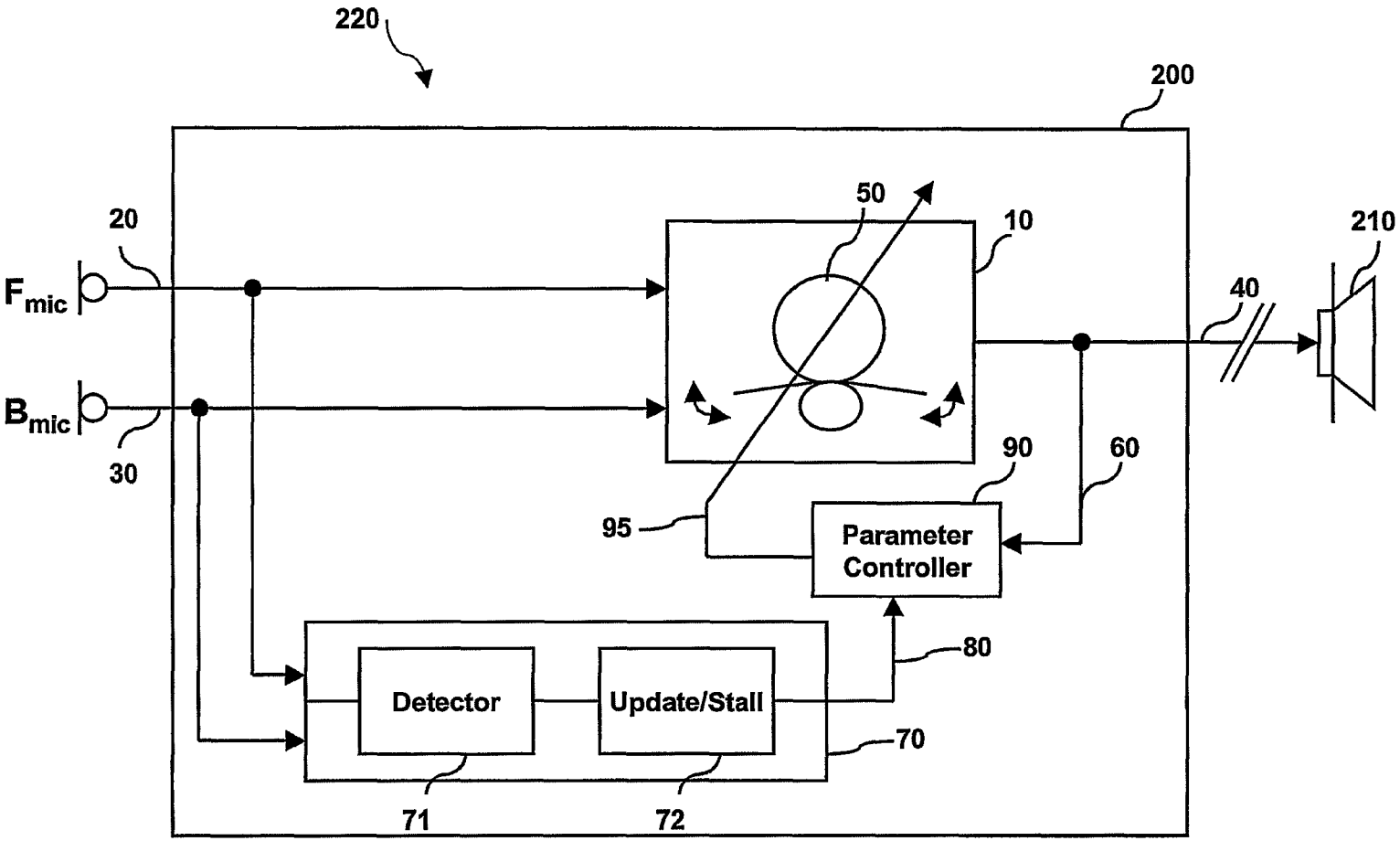
FIG. 2 depicts a block diagram which illustrates a hearing aid having a signal processing apparatus according to another embodiment of the present invention.

FIG. 2 shows a block diagram of a hearing aid 220 according to an embodiment of the present invention. The signal path of the hearing aid 220 comprises first and second input transducers, e.g., microphones Fmic and Bmic, transforming acoustic input signals into first and second electrical microphone signals 20, 30, a signal processing apparatus 200 with a controllable directional characteristic generating an electrical output signal 40 and an output transducer 210, e.g., a loudspeaker or receiver, for transforming the electrical output signal into an acoustic output signal. The signal processing apparatus 200 comprises a directional controller 10 with first and second microphone signals 20, 30 as input signals and output signal 40. The signal processing apparatus 200 further comprises desired signal detector 70 and parameter controller 90. Parameter controller 90 adjusts internal parameter(s) 95 of adaptive directional function 50 in order to minimize the fed back output signal 60 which is input to parameter controller 90. As a control signal, parameter controller 90 receives second control signal 80 supplied by desired signal detector 70. The desired signal detector 70 receives first and second microphone signals 20, 30 as input signals and further comprises a detector 71 and a update/stall-circuit 72.

Detector 71 detects whether first and second microphone signals are undesired signals or not. If the detector 71 detects that the input signals are undesired signals, the update/stall-circuit 72 provides a second control signal 80 which enables the parameter controller 90 to adjust the internal parameter(s) 95 in order to minimize the output signal 40. Otherwise, if the detector 71 detects that the input signals are desired signals, the update/stall-circuit 72 provides a second control signal 80 that indicates the parameter controller 90 to disable or stall the adaptation process and not to minimize the output signal further until the detector 71 detects again undesired signals.

Figure 3:
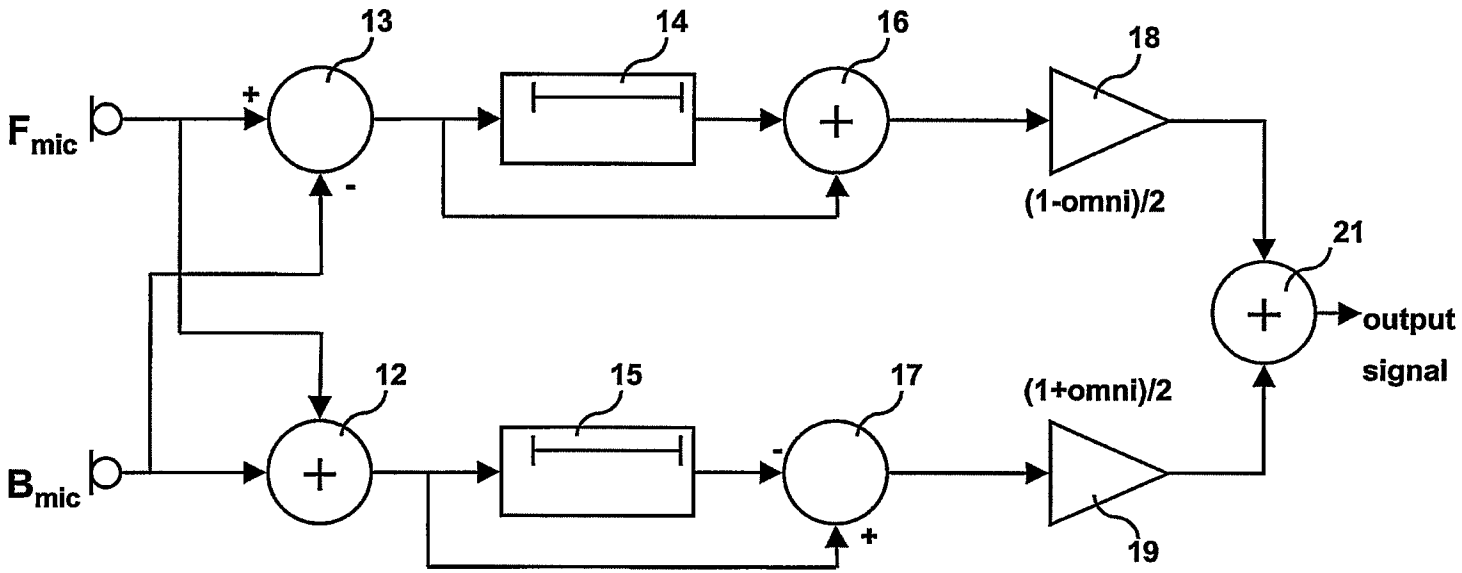
(prior art) Fig. 3
FIG. 3 depicts a block diagram of a prior art directional controller used in a signal processing apparatus according to an embodiment of the present invention.

FIG. 3 shows a directional controller according to WO 01/01731-A1 which may be implemented as directional controller 10 in a signal processing apparatus 100, 200 according to the present invention. In the directional controller as shown in FIG. 3, controllable attenuation and phase delay operations are applied to signals Xfront, Xback from front and back microphones Fmic and Bmic corresponding to first and second microphone signals 20, 30. The resulting signals are then combined to an output signal corresponding to output signal 40. The directional controller carries out an adaptive directional function and comprises a first adding circuit 12 connected with the front and back microphones Fmic and Bmic and a first subtraction circuit 13 having a positive input connected with the front microphone Fmic and a negative input connected with back microphone Bmic. First and second phase delay devices 14 and 15 are connected with the first subtraction and adding circuit 13 and 12, respectively. The second adding circuit 16 is connected with the first subtraction circuit 13 and the first phase delay device 14 and a second subtracting circuit 17 has its positive input connected with the first adding circuit 12 and its negative input connected with second phase delay device 15. A first controllable attenuator 18 acts on the signal from the second adding circuit 16 for attenuation of this signal by a factor (1−omni)/2 and a second controllable attenuator 19 acts on the signal from the second subtraction circuit 17 for attenuation of this signal by a factor (1+omni)/2, whereas a third adding circuit 21 is connected with the first and second attenuators 18 and 19 for addition of the signals therefrom to provide the overall combining signal to be supplied to the signal processor. The properties of this directional controller are such that it may advantageously be utilized in connection systems and methods according to the present invention. The combined output signals from adding circuit 21 is $$Y=X_{front}*(1-\text{omni}*e^{-j\omega T})+X_{back}*(\text{omni}-e^{-j\omega T})$$

where omni is an adjustable internal parameter 95, controlling attenuators 18 and 19 and having in the implementation of WO 01/01731-A1 a value in the range from 0 to 1.

If the acoustic delay between the back microphone Bmic and the front microphone Fmic is designated A, then $$X_{back}=X_{front}*e^{-j\omega A},$$

If an adaptive directional function is chosen with omni=0, the output signal becomes $$Y=X_{front}*(1-e^{-j\omega(A+T)}),$$

where T is a further adjustable internal parameter 95, controlling delay devices 14 and 15. If the delay T is selected equal to the delay A directly from the back microphone to the front microphone in the directional mode of operation (omni=0) then the part of the sound signal X coming directly from the back of the user is suppressed to the maximum extent and a directional characteristic know as a cardioid characteristic with a null-direction in the 180° direction is achieved.

By adjusting T<A, sound coming partly from the side of the user is cancelled, the direction of the canceling effect being controlled by the ratio of T/A.

However, according to the invention, the internal parameter omni may assume values outside the range of 0 to 1. When omni is reduced below 0, there will appear two null-directions, symmetrically about the 180° direction. Increasingly negative values of omni will move the null-directions further away from the 180° direction, e.g., at omni=−1.5 the null-directions will be at 80 and 280 degrees.

Conclusively, by adjusting the internal parameters 95 (omni and T), it will be possible to move the null-directions of the directional controller. This can, according to the invention, advantageously be exploited in an adaptive control of the directional controller in the signal processing apparatus according to the present invention.

Figure 4:
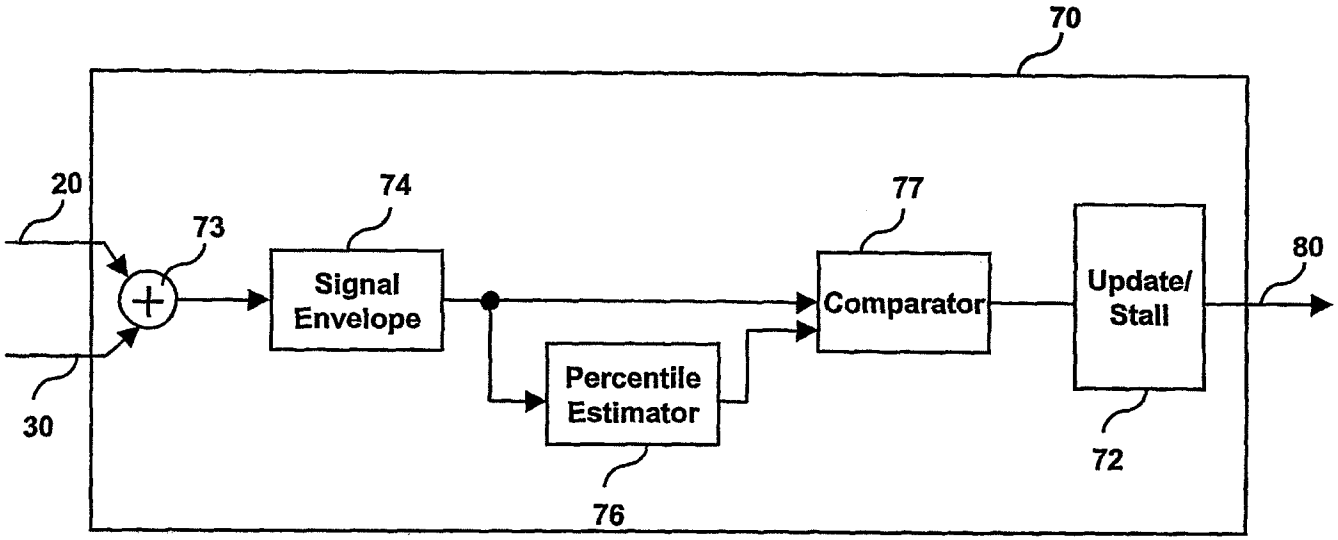
FIG. 4 depicts a block diagram of a desired signal detector according to an embodiment of the present invention.

FIG. 4 shows an embodiment of a desired signal detector 70 according to an embodiment of invention. The desired signal detector 70 may be used in a signal processing apparatus 100, 200 as described with reference to FIGS. 1 and 2. The circuit structure of the desired signal detector comprises an adding circuit 73 for adding first and second microphone signals 20, 30, which are connected to the adding circuit 73. The output of the adding circuit is connected to a signal envelope circuit 74 which produces the signal envelope of the added input signals. The signal envelope as output of the signal envelope circuit 74 is submitted to both a comparator 77 and a percentile estimator circuit 76. The percentile estimator circuit 76 generates a percentile estimator result, e.g., a 10% or 11% estimator result of the signal envelope. It is well known to a skilled person how to provide such a percentile estimator result with a percentile estimator known in the art. Examples of such percentile estimators are known from, e.g., U.S. Pat. No. 4,204,260, WO 95/15668, or WO 98/27787, however, these percentile estimators are not part of a desired signal detector.

Generally, the percentile estimator result output by the percentile estimator 76 may be any percentile estimator result in the range 0-100%. 0% percentile estimator result means that all signals input to the percentile estimator are detected to be above the percentile estimator result and will thus be considered as speech. This means the DSD detects desired signals all the time and the DSD causes the adaptation to not run at all. The other extreme, if the percentile estimator result is 100%, all signals input to the percentile estimator are detected to be below the percentile estimator result. This means the DSD considers the input signals as undesired signals so that the DSD will not stall the adaptation at all, and the directional adaptation will run as if the DSD was not present. However, although the percentile estimator result is not necessarily limited, for most applications a number between 5-90% is selected.

Accordingly, the percentage used for the DSD is not limited to a specific number, but there are however some practical limitation depending on the surrounding noise situation. The percentile estimator result should generally present a good border level between noise and speech (undesired and desired signals), so that levels below the percentile estimator result can be considered as essentially undesired signals and levels above can be considered as comprising desired signals. If the percentage is set too high, some part of the speech signal is below the percentile estimator result and will incorrectly be considered as noise. The adaptation will therefore not be stalled in every necessary occasion, and hence the directional adaptation will to some degree react on the speech as well as the noise. On the other hand, if the percentage is set too low, some part of the noise will be above the percentile estimator result and will therefore incorrectly be considered as speech. The directional adaptation is then stalled too often and, because of this, the adaptation is therefore slower than necessary, but will still only react on noise.

A low percentage percentile estimator, e.g., in the range 5-20%, will find the noise floor quite well, but the final choice will always be a matter of trade-offs, because different sound environments may yield different optimal values. However, with a DSD 70 having a percentile estimator with a percentile estimator result between 10-20% good results could be achieved by processing first and second microphone signals 20, 30 supplying speech signals of a single speaker in a quiet room.

The percentile estimator result as output of the percentile estimator 76 is supplied as second input signal to comparator 77. Comparator 77 compares two input signals, the signal envelope submitted by signal envelope circuit 74 and the percentile estimator result. The result of the comparison is submitted to an update/stall-circuit 72 which produces the second control parameter 80.

Figure 6:
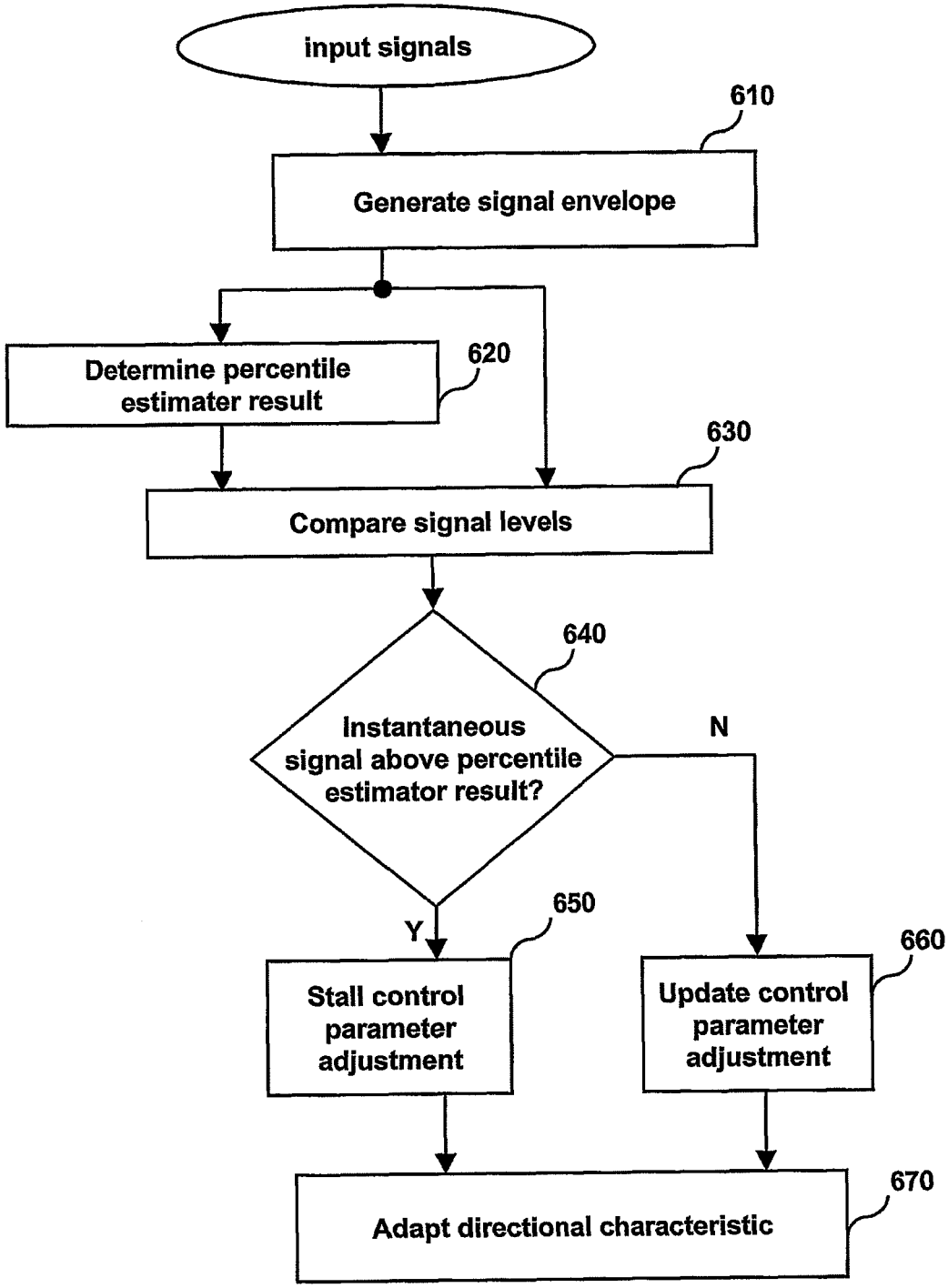
FIG. 6 depicts a flow diagram illustrating another method according to an embodiment of the present invention.

The function of the analyzer, also referred to as the desired signal detector (DSD) 70, is now described with reference to FIG. 6 showing a flow diagram of a method according to the present invention.

In operation 610, the signal envelope is generated from said input signals. The input signals may be the added first and second microphone signals 20, 30 according to FIG. 4. In accordance to another embodiment (not shown), the desired signal detector does not comprise adding circuit 73 and the input signal to the signal envelope circuit 74 is either the first or the second microphone signal. The adding circuit may be left out according to the presumption that at least one of the first front microphone Fmic or the second back microphone Bmic is a microphone with an omni-directional characteristic so that this microphone submits a microphone signal corresponding to the sound signals reaching that microphone from any direction. Thus, the signal envelope of the sound signals surrounding the user may be generated from only one microphone signal in order to keep the overall circuitry more simple.

From the signal envelope a percentile estimator result, e.g., a 10% percentile estimator result, is determined in operation 620. The signal levels of both signals, the percentile estimator result and the signal envelope, are then compared in operation 630. In particular, comparator 77 detects when the instantaneous signal of the signal envelope goes above the percentile estimator result and also when the instantaneous signal of the signal envelope goes below the percentile estimator result (operation 640). When it is detected that the instantaneous signal is above the percentile estimator result, the desired signal detector concludes "desired signals" in the input signals and the control parameter adjustment is stalled in operation 650. In order to stall the adaptation, update/stall-circuit 72 submits second control parameter 80 indicating to the parameter controller 90, or directly to the directional controller 10, to disable adaptation of the directional characteristic by the adaptive directional function 50.

If in operation 640 it is detected that the instantaneous signal is below the percentile estimator result, the desired signal detector concludes "undesired signal" as input signal and allows to update the control parameter adjustment in operation 660 by setting an enable-signal as second control parameter 80 to adapt the directional characteristic by adjusting the internal control parameter for the adaptive directional function in operation 670.

According to another embodiment of the present invention (not shown), the desired signal detector comprises filter circuitry which is capable to distinguish between high and low frequencies in the input signals 20, 30. If the detector 71 then detects that the input signals comprise signals in a certain frequency range, e.g., corresponding to voice signals, the desired signal detector concludes "desired signal" and proceeds with operation 650. Otherwise, if the detector 71 detects that the input signals are outside a certain frequency range, the desired signal detector concludes "undesired signal" and proceeds with operation 660.

According to another embodiment of the present invention, detector 71 detects the level of the input signal and decides, in an operation similar to operation 640, whether the level of the input signal is above or below a certain preset level, and if the input level is below that preset level, the DSD concludes "undesired signal" and proceeds with operation 660 and vice versa.

Figure 9:
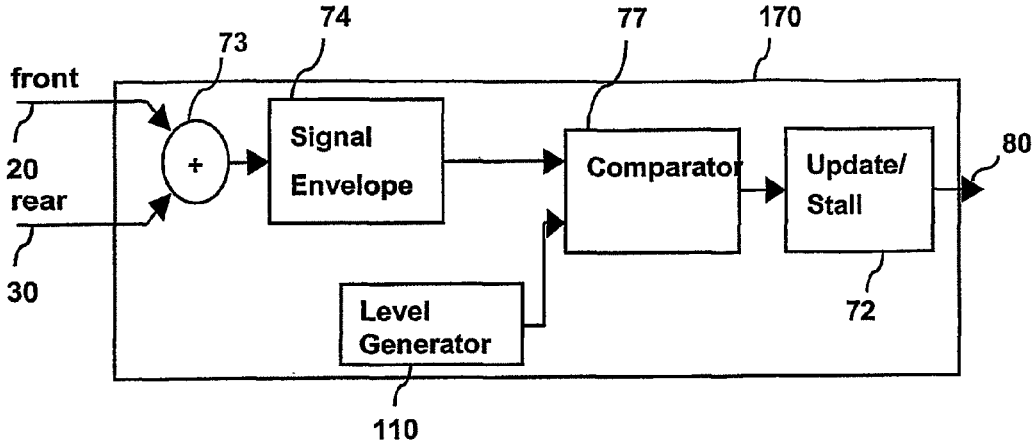
FIG. 9 depicts a block diagram of a desired signal detector according to another embodiment of the present invention.

FIG. 9 shows an embodiment of a desired signal detector 170 according to an embodiment of the invention in which such a level detection is implemented to distinguish between desired and undesired signals. The circuit structure of the DSD 170 is similar to the one of the DSD 70 described with reference to FIG. 4. The DSD 170 comprises a level generator 110 which replaces the percentile estimator 76 of DSD 70. The level generator 110 does not necessarily need any input, but provides a fixed signal level to the comparator 77 which compares two input signals, i.e. the signal envelope submitted by signal envelope 74 and the level submitted by the level generator 110. The result of the comparison is submitted to the update/stall-circuit 72 which again produces the second control parameter 80. The function of the DSD 170 is also similar to the function of the DSD 70, except for the fact, that the level generator 110 outputs a fixed signal level which does not depend on the signal envelope of the input signals 20, 30. Therefore, in operation 640, it is decided whether the level of the instantaneous signal envelope is above or below the signal level of the level generator.

Depending on the desired performance of the DSD 170 and the choice of the hearing aid designer, the value of the signal level generated by the level generator 110 and serving as a threshold and the update and stall criteria may be adjusted accordingly. E.g., the designer might want to use this capability to disable adaptation below a predetermined lower threshold in order to suppress updating in environments where the signal is dominated by intrinsic microphone noise. Another example might be the use of this capability to disable adaptation above a predetermined high threshold in order to suppress updating in an environment dominated by wind noise or in an environment where the signal might be distorted due to a level exceeding the dynamic range of the hearing aid.

According to an embodiment of DSD 170, the update/stall-circuit 72 outputs an enable-signal if the comparator 77 indicates that the signal envelope is equal to or below the threshold, and outputs a disable-signal if the comparator indicates that the signal envelope is above the threshold. However, in another embodiment of DSD 170, the update and stall criteria could as well be reversed, i.e. the update/stall-circuit 72 outputs a disable-signal if the comparator 77 indicates that the signal envelope is equal to or below the threshold, and outputs an enable-signal if the comparator indicates that the signal envelope is above the threshold.

According to another embodiment of the present invention, detector 71 of DSD the calculates a correlation coefficient of the input signals, and the DSD concludes "desired signal" if the correlation coefficient reaches a certain value and then adjusts the second control parameter 80 accordingly.

Figure 10:
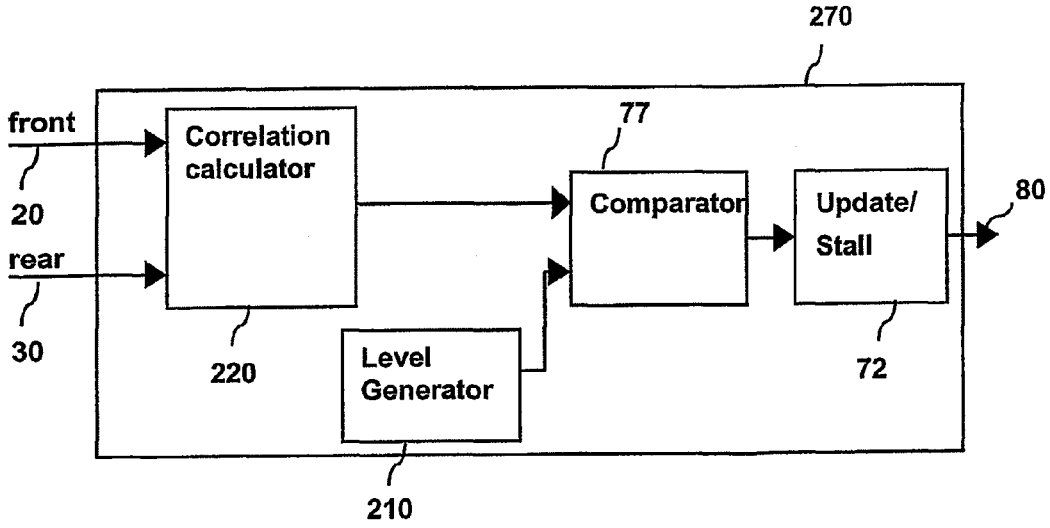
FIG. 10 depicts a block diagram of a desired signal detector (DSD) according to still another embodiment of the present invention.

FIG. 10 shows an embodiment of a desired signal detector 270 according to still another embodiment of the present invention. Also the DSD 270 may be implemented in a signal processing apparatus 100, 200 as described with reference to FIGS. 1 and 2. The circuit structure of the DSD 270 comprises a correlation calculator 220 which calculates a correlation coefficient between the two input signals 20, 30 and submits this correlation coefficient to comparator 77. The comparator 77 also receives a certain level signal from level generator 210, compares these two input signals and submits a comparison result to the update/stall-circuit 72 which produces the second control parameter 80.

With the correlation calculator 220 it is determined whether the input signals (first and second microphone signal) 20, 30 are generated from the same sound source or not. For example, when the hearing aid is operated in a silent environment, each of the microphone signals contains only noise generated by the respective microphone itself. Thus, in this case, the input signals are generated by independent and thus non-correlated signal sources, namely the individual microphones. In this and other cases the correlation coefficient indicates whether at least one of the microphone signals is dominated by noise or distortion. For example, the adaptation may be stalled by transmitting a respective second control parameter 80 when at least one of the input signals 20, 30 is dominated by noise or distortion, so that comparator 77 detects falling of the correlation coefficient under the signal level generated by level generator 210. Level generator 210 is at least similar to level generator 110, and the generated signal level, which serves as a threshold in the comparator 77, may also be adjusted depending on the desired performance and choice of the hearing aid designer. In WO 02/30150, a correlation detector for detection of non-correlated first and second input signals and for generation of a control signal is provided by way of example. Depending on the desired performance of the DSD 270 and the choice of the DSD designer, the update and stall criteria may be adjusted based on the value of the correlation coefficient.

According to an embodiment of DSD 270, the update/stall-circuit 72 outputs an enable-signal if the comparator 77 indicates that the correlation coefficient is equal to or below the threshold, and outputs a disable-signal if the comparator indicates that the correlation coefficient is above the threshold. However, in another embodiment of DSD 270, the update and stall criteria could as well be reversed, i.e. the update/stall-circuit 72 outputs a disable-signal if the comparator 77 indicates that the correlation coefficient is equal to or below the threshold, and outputs an enable-signal if the comparator indicates that the correlation coefficient is above the threshold.

According to further embodiments of the present invention, the selection between desired signals and undesired noise is implemented in various ways using different detectors 71 in the DSD 70 depending on the type of signal. The selection may be based, e.g., on statistical analysis, frequency shaping, detection of certain non-linearities, or others.

Figure 7:
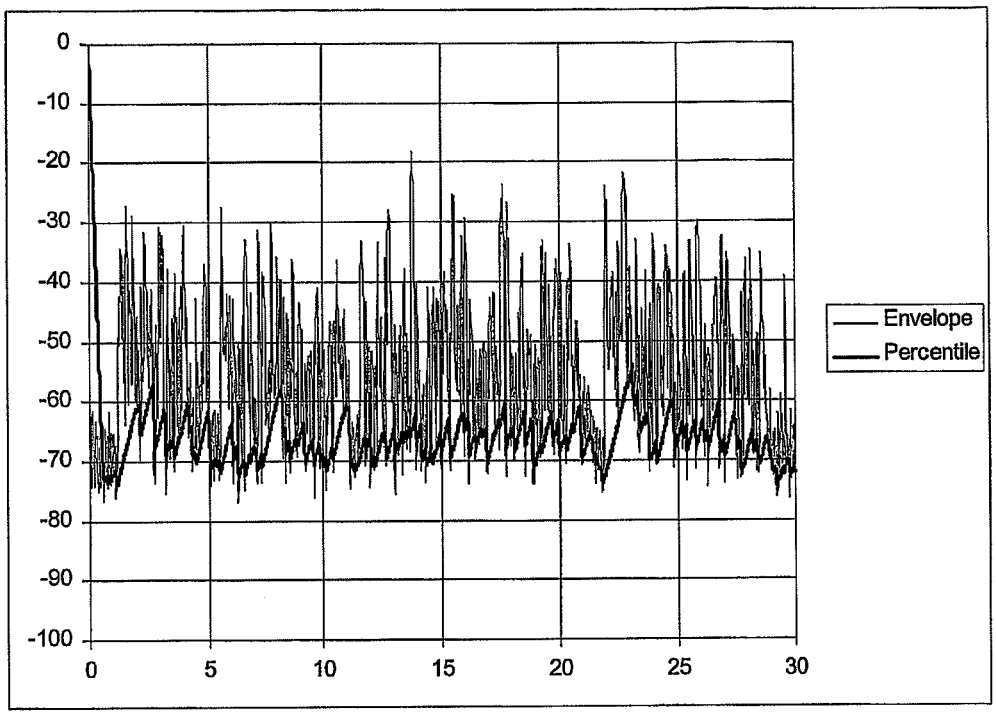
FIG. 7 depicts a signal diagram which illustrates a signal envelope and 11% percentile estimator result of a speech signal of a single speaker in connection with the desired signal detector as shown in FIG. 4.

FIG. 7 shows a signal diagram illustrating a signal envelope and an 11% percentile estimator result of a single speaker over a time period of 20 seconds. The signal envelope and the 11% percentile estimator result have been achieved by using a digital implementation with a 32 kHz sampling frequency and a 24 Bit ADC and a desired signal detector 70 with an signal envelope circuit 74 and a percentile estimator 76 according to the present invention. The speaker starts speaking at time=1.5 sec in a quiet room and at time=5 sec the speaker, still speaking, moves from the front to one side of the user.

Figure 8:
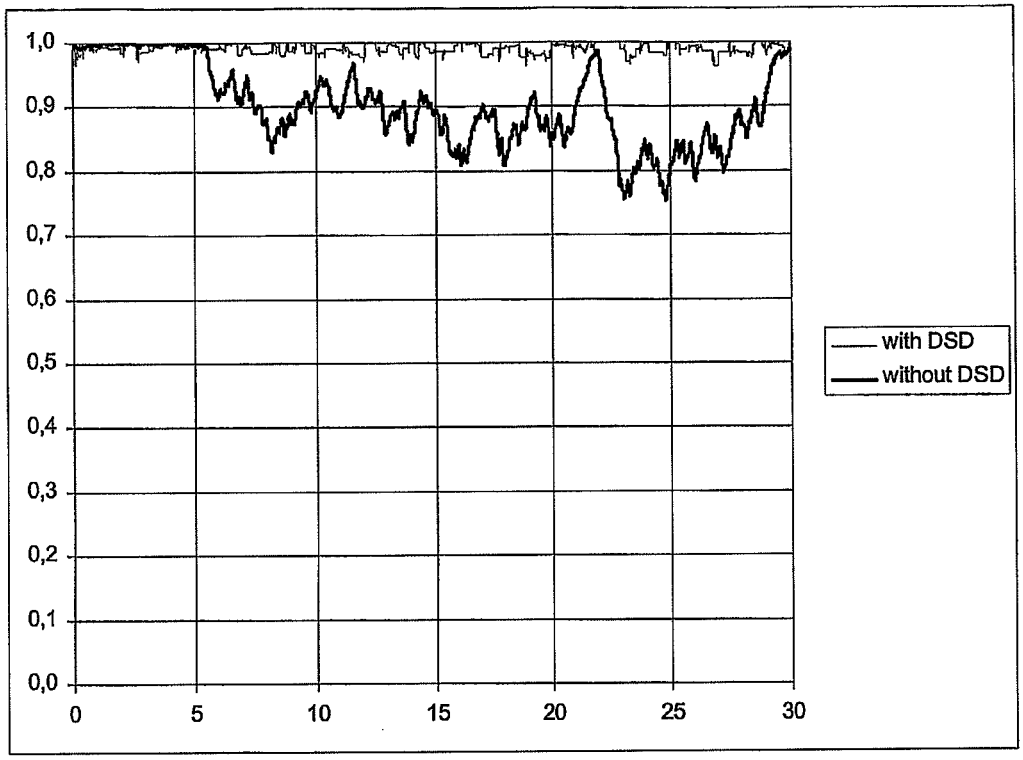
FIG. 8 depicts a signal diagram illustrating the directional parameter behavior of an adaptive directional function according to an embodiment of the present invention in comparison to a prior art directional parameter behavior.

FIG. 8 shows the behavior of the internal directional parameter omni (full line) in the adaptive directional function according to the present invention with the DSD included (parameter value of omni=1 means omni-directional, 0.5 means cardioid and 0 means bi-directional characteristic). In comparison to that, FIG. 8 also shows the behavior of the internal directional parameter omni of a prior art directional controller without a DSD (dotted line). When comparing the directional parameter behavior with and without DSD, the improved behavior of parameter omni when applying a signal processing apparatus according to the present invention may simply be recognized for a skilled person. According to the full line, the parameter omni is adjusted between 1 and 0.97 over the entire time frame of 20 seconds. Even if the speaker moves to one side of the user after 5 seconds, the value of omni stays in that range which means that the adaptive directional function still employs a nearly omni-directional characteristic even if the speaker moves out of the frontal direction. As a result, the desired speech signal is not damped during the whole time frame since the directional characteristic remains in nearly omni-directional mode. Furthermore, it can be seen from the directional parameter behavior with DSD, that the adaptive directional function tries to dump undesired noise by adjusting the internal parameter omni below the value=1 in speech pauses in order to minimize the output signal 40.

Contrary to that, a prior art directional controller without DSD adjusts the directional parameter omni in the same situation as shown by the dotted line in FIG. 8. In the first six seconds, the directional controller stays in omni-directional mode. After the speaker has moved to one side of the user, the prior art directional controller tries to further minimize the output signal by adjusting the parameter omni to a more directional mode, down to a value=0.8 resulting in an undesired damping of the actual desired speech signal and a significant modulation of the microphone noise, which is disadvantageous as described in the background section of the specification.

According to an embodiment of the present invention, the frequency spectrum of the first and second microphone signals 20, 30 may be divided by band-split filters (not shown), respectively, into a number, e.g., three, of channels with respective limited frequency ranges. Each of the band-limited channels is then handled by a corresponding signal processing apparatus 100, 200, whereby each signal processing apparatus operates in a band-limited channel. This system allows the directional characteristics to be different among these channels, such that the analysis by which signals are classified as desired and undesired signals and the directional characteristics is adjusted is done independently in respective frequency bands.

Finally, it may be pointed out that it is clear for a person skilled in the art that embodiments described with respect to the Figures of the present invention may possibly be simplified in order to better describe the key features of the invention.

According to further embodiments of the invention, embodiments or features of embodiments described above may be combined in any combination useful in a directional system for minimizing noise.

Furthermore, it is apparent to one skilled in the art that features described in this specification or in the claims that follow, even if not explicitly described, may be claimed in any useful combination.

We claim:

1. A hearing aid comprising a first and a second input microphone, a directional controller for receiving first and second microphone signals from said microphones and outputting an output signal, and a signal analyzer for detecting whether at least one of said first and second microphone signals comprises desired signals and for setting a disable signal in the event desired signals are detected, wherein said directional controller is adapted for performing an adaptive operation so as to minimize the output signal only while said disable signal is not set, and wherein setting said disable signal prevents said directional controller from performing said adaptive operation in the presence of noise in either of said first and second microphone signals.

2. The hearing aid according to claim 1, wherein said signal analyzer is adapted to maintain said disable signal for a predetermined time interval upon the detection of desired signals.

3. The hearing aid according to claim 1, comprising a number of signal processing apparatuses, each signal processing apparatus comprising band-split filters dividing the frequency spectrum of the first and second microphone signals into a number of channels with respective limited frequency ranges, wherein each respective signal processing apparatus employs a respective directional characteristic by separately processing respective frequency ranges of said microphone signals.

4. A hearing aid comprising a first and a second input microphone adapted for generating a first and a second microphone signal, a directional controller for receiving said first and second microphone signals and processing them according to a directional characteristic and outputting a directional controller output signal, a detector receiving at least one of said first and second microphone signals, and an update-circuit receiving the output of the detector; wherein said update-circuit outputs an enable-signal if said detector detects undesired signals as input signals, and outputs a disable-signal if said detector does not detect undesired signals as input signals; and wherein said directional controller is adapted to minimize said directional output signal by adapting said directional characteristic when enabled by said enable signal.

5. The hearing aid according to claim 4, wherein the directional controller adapts the directional characteristic by adjusting an internal control parameter of an adaptive directional function only while enabled by means of a second control parameter submitted by a signal analyzer.

6. The hearing aid according to claim 5, wherein the adaptive directional characteristic is defined by the formula:

$$Y=X_{front}*(1-\text{omni}*e^{-j\omega T})+X_{back}*(\text{omni}-e^{-j\omega T})$$

where omni is the internal control parameter and T is a predetermined acoustic delay.

7. The hearing aid according to claim 6, comprising a parameter controller receiving a fed back output signal and a second control parameter and outputting said internal control parameter, wherein said parameter controller adjusts the internal control parameter in order to minimize said fed back output signal by applying a minimization-algorithm if the second control parameter indicates an enable-signal.

8. The hearing aid according to claim 4, wherein said detector comprises:

a signal envelope circuit receiving at least one of said first and second microphone signals and adapted for generating a signal envelope;

a percentile estimator generating a percentile estimator result of said signal envelope; and a comparator comparing signal levels of said signal envelope and said percentile estimator result;

wherein said update-circuit outputs an enable-signal if the comparator indicates that the signal envelope is equal to or below the percentile estimator result, and outputs a disable-signal if the comparator indicates that the signal envelope is above the percentile estimator result.

9. The hearing aid according to claim 4, wherein said detector comprises:

a signal envelope circuit receiving at least one of said first and second microphone signals and generating a signal envelope of said microphone signals;

a level generator generating a signal level as a threshold; and a comparator detecting whether said signal envelope is above or below said threshold;

wherein said update-circuit outputs either an enable- or a disable-signal, depending on the comparator result.

10. The hearing aid according to claim 4, wherein said detector decides among detection of desired and undesired signals by using statistical analysis, frequency shaping or by detecting of certain non-linearities in said microphone signals.

11. The hearing aid according to claim 4, wherein said detector comprises filter circuitry differentiating said microphone signals in certain frequency bands, wherein said update-circuit outputs an enable-signal if said detector only detects signals in undesired frequency bands, and outputs a disable-signal if said detector detects also signals in desired frequency bands.

12. A method of controlling the directional characteristic of a hearing aid having spaced apart first and second microphones, said method comprising the steps of:

receiving in a directional controller first and second microphone signals supplied by said first and second microphones, respectively, generating an output signal by combining said first and second microphone signals according to a directional characteristic;

applying an adaptive directional function in which at least one of said first and second microphone signals are delayed or attenuated according to an internal control parameter and then combined to provide an output signal, detecting whether at least one of said first and second microphone signals contain a desired signal and signaling the detection of a desired signal by setting a disable signal, and disabling the adaptive directional function if said disable signal is set, wherein setting said disable signal prevents said directional controller from performing said adaptive directional function when noise is present in one of said first and second microphone signals.

13. The method according to claim 12, comprising the steps of:

detecting whether at least one of said first and second microphone signals contain undesired signals and generating a detection signal indicating a result of said detection; and adapting the directional characteristic in order to minimize the output signal only if said detection signal indicates that undesired signals have been detected.

14. The method according to claim 13, wherein said output signal is generated by applying an adaptive directional function in which at least one of said first and second microphone signals are delayed or attenuated according to an internal control parameter and then combined to said output signal, and in which the internal control parameter is adjusted in order to minimize the output signal only if undesired signals have been detected.

15. The method according to claim 12, comprising:

generating a signal envelope of an input signal corresponding to one of said first and second microphone signals or a sum of said first and second microphone signals;

calculating a percentile estimator result of said envelope;

comparing signal levels of said signal envelope and said percentile estimator result;

updating internal control parameter adjustment if said comparing operation concludes that the signal envelope is equal to or below the percentile estimator result; and stalling internal control parameter adjustment if said comparing operation concludes that the signal envelope is above the percentile estimator result.

* * * * *